US011088483B2

(12) United States Patent
Chiba et al.

(10) Patent No.: US 11,088,483 B2
(45) Date of Patent: Aug. 10, 2021

(54) TERMINAL METAL FITTING WITH SPRING CONTACT AND SPRING CONTACT DEFORMATION RESTRICTION PORTION

(71) Applicant: Yazaki Corporation, Tokyo (JP)

(72) Inventors: Shingo Chiba, Makinohara (JP); Naokazu Nagasaka, Makinohara (JP); Dacheng Jin, Makinohara (JP); Atsuhito Saito, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/419,646

(22) Filed: May 22, 2019

(65) Prior Publication Data

US 2019/0393637 A1 Dec. 26, 2019

(30) Foreign Application Priority Data

Jun. 26, 2018 (JP) ..... JP2018-121087

(51) Int. Cl.

| | |
|---|---|
| ***H01R 13/11*** | (2006.01) |
| ***H01R 4/18*** | (2006.01) |
| ***H01R 13/05*** | (2006.01) |
| ***H01R 13/15*** | (2006.01) |
| ***H01R 13/42*** | (2006.01) |

(Continued)

(52) U.S. Cl.

CPC ..... *H01R 13/113* (2013.01); *H01R 4/18* (2013.01); *H01R 13/055* (2013.01); *H01R 13/114* (2013.01); *H01R 13/15* (2013.01); *H01R 13/42* (2013.01); *H01R 13/502* (2013.01); *H01R 13/533* (2013.01); *H01R 13/62* (2013.01); *H01R 4/185* (2013.01); *H01R 13/11* (2013.01); *H01R 13/111* (2013.01); *H01R 13/17* (2013.01); *H01R 13/187* (2013.01); *H01R 13/24* (2013.01); *H01R 13/4223* (2013.01); *H01R 43/16* (2013.01)

(58) Field of Classification Search

CPC ... H01R 13/187; H01R 13/113; H01R 13/111; H01R 43/16; H01R 13/11; H01R 13/114; H01R 13/17; H01R 13/055; H01R 13/15; H01R 13/24; H01R 4/18; H01R 13/42; H01R 13/4223; H01R 4/185

USPC ..... 439/852, 843, 851

See application file for complete search history.

(56) References Cited

U.S. PATENT DOCUMENTS 5,217,382 A * 6/1993 Sparks ..... H01R 13/187 439/161
5,593,328 A * 1/1997 Okada ..... H01R 13/11 439/843

(Continued)

FOREIGN PATENT DOCUMENTS

EP 0932917 A1 8/1999
JP 2006-100232 A 4/2006

(Continued)

*Primary Examiner* — Abdullah A Riyami
*Assistant Examiner* — Justin M Kratt
(74) *Attorney, Agent, or Firm* — Banner & Witcoff, Ltd.

(57) ABSTRACT

A terminal metal fitting includes a tubular box portion receiving a counterpart terminal; a terminal spring extending from an inner wall surface of the box portion to press and contact the counterpart terminal; and a deformation restriction portion restricting deformation of the terminal spring within a preset range when the terminal spring contacts the counterpart terminal. The deformation restriction portion has a chamfered portion to contact the terminal spring.

2 Claims, 4 Drawing Sheets

(51) Int. Cl.

| | |
|---|---|
| ***H01R 13/502*** | (2006.01) |
| ***H01R 13/533*** | (2006.01) |
| ***H01R 13/62*** | (2006.01) |
| *H01R 43/16* | (2006.01) |
| *H01R 13/24* | (2006.01) |
| *H01R 13/422* | (2006.01) |
| *H01R 13/187* | (2006.01) |
| *H01R 13/17* | (2006.01) |

(56) References Cited

U.S. PATENT DOCUMENTS

| | | | | |
|---|---|---|---|---|
| 6,305,992 | B1 | 10/2001 | Bouda et al. | |
| 6,527,601 | B2 * | 3/2003 | Chen | H01R 13/187 439/851 |
| 8,523,619 | B2 * | 9/2013 | Itou | H01R 13/113 439/852 |
| 2006/0068650 | A1 | 3/2006 | Shimizu | |
| 2009/0253314 | A1 | 10/2009 | Shimizu | |
| 2012/0094550 | A1 | 4/2012 | Itou et al. | |
| 2013/0065436 | A1 * | 3/2013 | Hirabayashi | H01R 13/4223 439/595 |
| 2013/0224983 | A1 | 8/2013 | Matsumura et al. | |
| 2014/0287634 | A1 * | 9/2014 | Tsuji | H01R 13/187 439/852 |
| 2016/0013569 | A1 | 1/2016 | Chikusa | |

FOREIGN PATENT DOCUMENTS

| | | | |
|---|---|---|---|
| JP | 2009-252495 | A | 10/2009 |
| JP | 2012-084403 | A | 4/2012 |
| JP | 2014-216256 | A | 11/2014 |
| JP | 5682520 | B2 | 3/2015 |
| WO | 98/018181 | A1 | 4/1998 |
| WO | 2014/136809 | A1 | 9/2014 |

* cited by examiner

TERMINAL METAL FITTING WITH SPRING CONTACT AND SPRING CONTACT DEFORMATION RESTRICTION PORTION

CROSS-REFERENCES TO RELATED APPLICATION(S)

This application is based on and claims priority from Japanese Patent Application No. 2018-121087 filed on Jun. 26, 2018, and the entire contents of which are incorporated herein by reference.

BACKGROUND

Field of the Invention

The present invention relates to a terminal metal fitting.

Description of Related Art

Terminal metal fittings are known which are equipped with a deformation restriction portion for restricting, during fitting between the metal fitting incorporating a terminal spring and a counterpart terminal, the deformation of the terminal spring so as to prevent the terminal spring from suffering unintended, excessive deformation.

As for details of the above terminal metal fittings, refer to JP 2014-216256 A and JP 2012-084403 A.

SUMMARY

In the above-described conventional terminal metal fittings, a penetration hole is formed through a wall of a tubular box portion of the terminal metal fitting and, for example, a tip portion of the terminal spring that has been deformed excessively being pushed by an inclined counterpart terminal goes into the through-hole. And the tip portion of the terminal spring comes into contact with a circumferential surface of the through-hole, whereby the terminal spring is prevented from being deformed excessively.

However, in conventional terminal metal fittings, a circumferential edge of the through-hole has a sharply angled edge and stress is prone to concentrate in a portion, to come into contact with the circumferential edge of the through-hole, of the terminal spring. As a result, the terminal spring may be deformed elastically in and around the contact portion to lose its designed elasticity, possibly resulting in lowering of the reliability of electrical connection between the terminal spring and the counterpart terminal. It is therefore desirable that such reduction in the elasticity of the terminal metal fitting be suppressed to as small a level as possible.

An object of the invention is to provide a terminal metal fitting capable of suppressing deformation of a terminal spring of the terminal metal fitting.

Embodiments of the present invention provide the following items (1) and (2):

(1). A terminal metal fitting comprising:

a tubular box portion receiving a counterpart terminal;

a terminal spring extending from an inner wall surface of the box portion to press and contact to the counterpart terminal; and a deformation restriction portion restricting deformation of the terminal spring within a preset range upon the terminal spring contacting to the counterpart terminal, the deformation restriction portion having a chamfered portion as a portion to contact to the terminal spring.

(2) The terminal metal fitting according to the item (1), further comprising a supporting point portion having a shape to project inside of the box portion and serving as a supporting point upon the terminal spring pressing and contacting to the counterpart terminal, wherein the terminal spring has a cantilevered-shape; and the deformation restriction portion restricts the deformation of the terminal spring within the preset range by contacting to the terminal spring at a position closer to a free end of the terminal spring than a contacting portion of the supporting point portion.

According to first aspect of the invention, relating to the item (1), when, for example, an inclined counterpart terminal is brought into contact with the terminal spring inside the tubular box portion, though large stress may act on the terminal spring, since the portion, to come into contact with the terminal spring, of the deformation restriction portion is chamfered, stress is less prone to concentrate in a contact portion of the terminal spring than in a case that the portion to come into contact with the terminal spring is a sharply angled edge. Thus, the terminal spring is less prone to plastic deformation. As such, the terminal metal fitting having the above configuration can suppress the deformation of its terminal spring.

According to second aspect of the invention, relating to the item (2), when, for example, an inclined counterpart terminal is brought into contact with the terminal spring, a prescribed portion, closer to the free end than the portion in contact with the supporting point portion is, of the terminal spring comes into contact with the chamfered portion For example, when this contact occurs, in a case that the portion, between the supporting point portion and the deformation restriction portion, of the terminal spring is curved so as to be convex toward the counterpart terminal, the convex-curved portion of the terminal spring is stretched being pushed by the counterpart terminal, which may cause an event that the portion, in contact with the deformation restriction portion, of the terminal spring slides on the deformation restriction portion. In this case, since the portion to come into contact with the terminal spring is chamfered, the sliding is smoother than in a case that the portion to come into contact with the terminal spring is a sharply angled edge. As a result, the deformation of the terminal spring can be suppressed.

The invention can provide a terminal metal fitting capable of suppressing deformation of a terminal spring of the terminal metal fitting.

Several aspects of the invention have been described briefly above. The further details of the invention will be made clearer if the following description is read through with reference to the accompanying drawings.

DETAILED DESCRIPTION

Embodiment

An engagement structure 1 of a housing 20 and terminal metal fittings 10 according to an embodiment of the present invention will be hereinafter described with reference to the drawings. In the following, for convenience of description, in the axial direction (fitting direction) of each terminal metal fitting 10, the side (left side in FIGS. 1A and 1B to FIG. 4) of fitting of a counterpart terminal (see FIG. 2B) will be referred to as a tip side (or front side) and the side (right side in FIGS. 1A and 1B to FIG. 4) opposite to the tip side will be referred to as a base side (or rear side). Furthermore, the top side and the bottom side are defined as those in FIGS. 1A and 1B to FIG. 4.

Figure 3A:
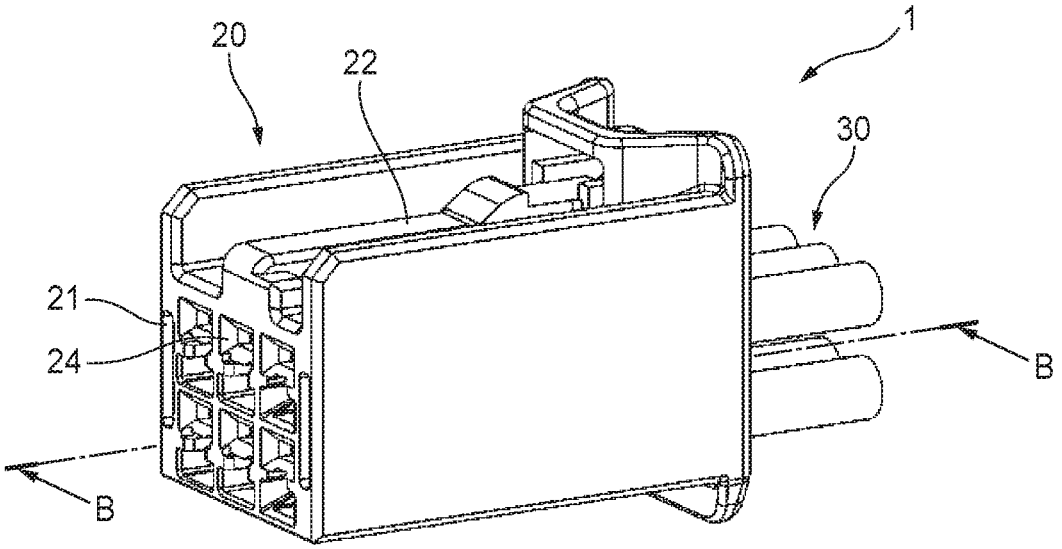
FIG. 3A is a perspective view showing a state that terminal metal fittings each of which is shown in FIGS. 1A and 1B are housed in a housing.
Figure 3B:
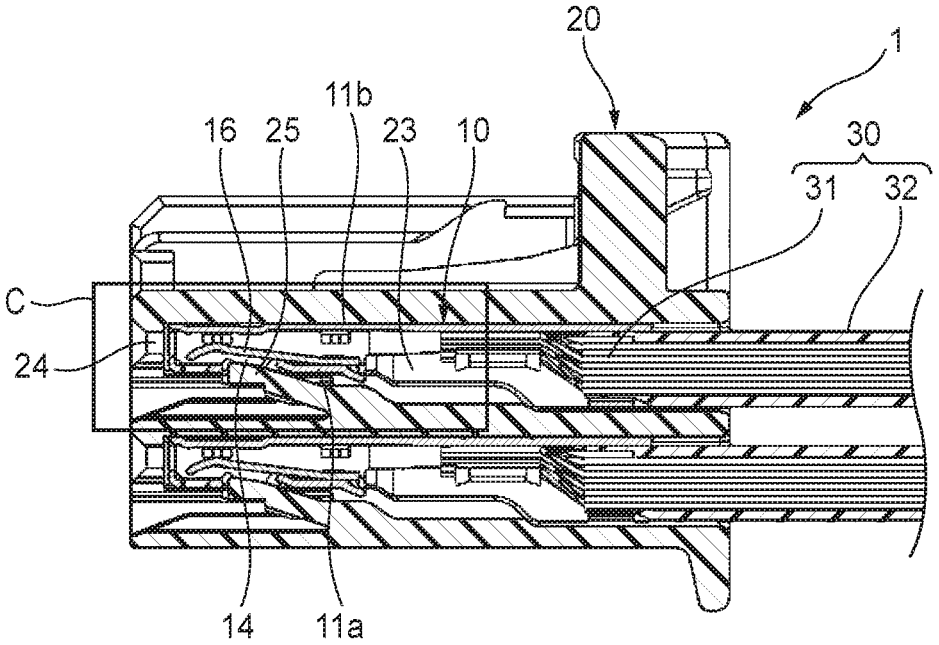
FIG. 3B is a sectional view taken along line B-B in FIG. 3A.

As shown in FIGS. 3A and 3B, the engagement structure 1 is equipped with the terminal metal fittings 10 to which terminated end portions of electric wires 30 are connected, respectively, and the housing 20 which houses the terminal metal fittings 10. As shown in FIG. 3B, each electric wire 30 is composed of a core wire 31 and a resin covering 32 which covers the core wire 31.

Figure 1A:
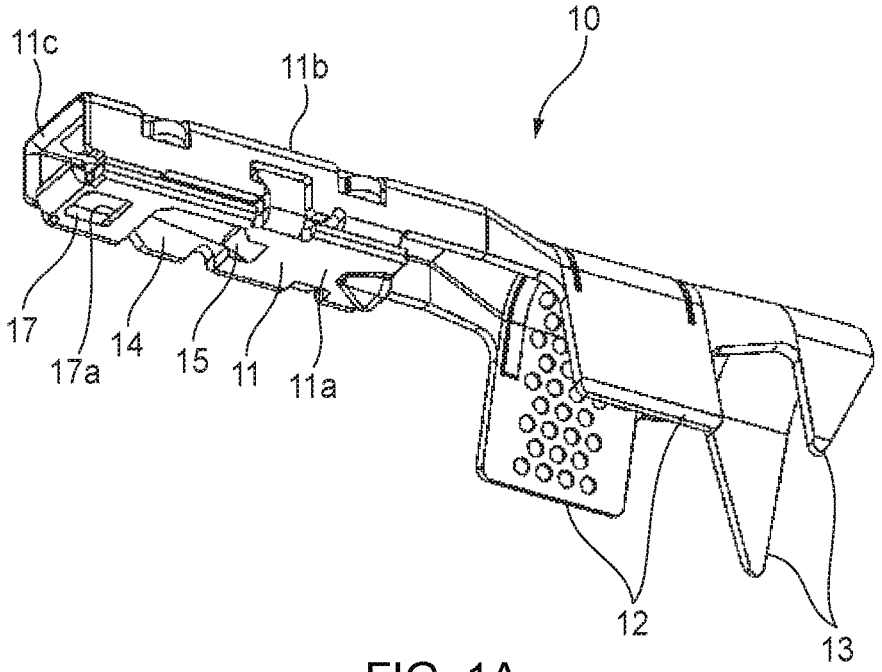
FIG. 1A is a perspective view of a terminal metal fitting according to an embodiment.
Figure 1B:
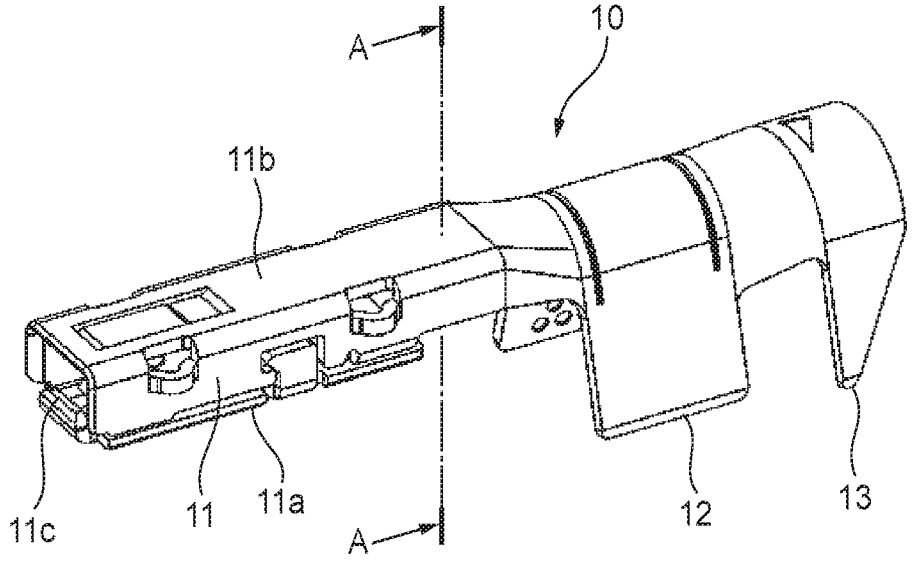
FIG. 1B is a perspective view of the terminal metal fitting as viewed from an angle that is different than in FIG. 1A.
Figure 2A:
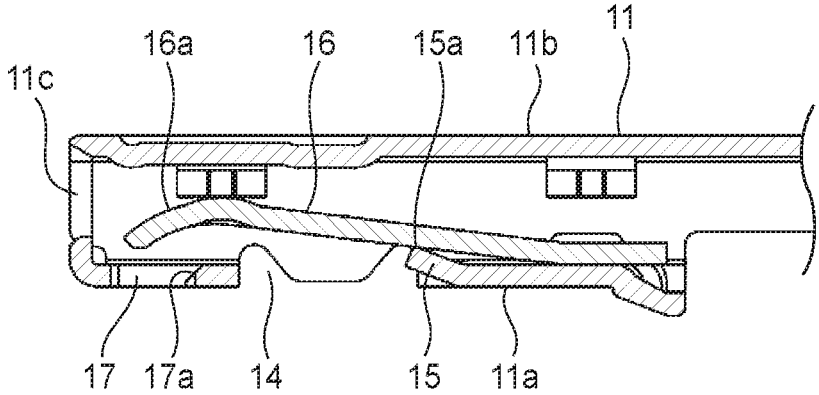
FIG. 2A is a sectional view taken along line A-A in FIG. 1B.

As shown in FIGS. 1A and 1B and FIG. 2A, each terminal metal fitting 10 is a female terminal formed by pressing a metal plate and is equipped with a rectangular-cylinder-shaped box portion 11 into which a counterpart terminal (male terminal (see FIG. 2B)) is to be fitted, core wire swaging pieces 12 for crimping the core wire 31 of an electric wire 30, and covering swaging pieces 13 to be swaged on the covering 32 of the electric wire 30 and thereby fix the electric wire 30.

As shown in FIGS. 1A and 2A, a bottom wall 11*a* of the box portion 11 is formed with, approximately at the center in the fitting direction, a rectangular lock hole 14 (through-hole) for receiving a lance 25 (see FIGS. 3B and 4; described later) which is provided in the housing 20.

A portion, around a base-side end surface of the lock hole 14, of the bottom wall 11*a* of the box portion 11, is formed with, at the center in the width direction, a supporting point portion 15 which is a cut-and-erected piece that is cut-separated and erected obliquely toward the inside of the box portion 11 (i.e., upward) and toward the tip side like a cantilever. The width of the supporting point portion 15 is a little greater than that of the lance 25. Thus, a tip side end portion of the lock hole 14 and the supporting point portion 15 form a space that can function as a space capable of receiving part of the lance 25. Also, the supporting point portion 15 defines a frontward area vacated by erecting the cut-and-erected piece, and when part of the lance 25 is received into the lock hole 14, a part of the lance 25 is located inside the frontward area.

As shown in FIG. 2A, a plate-like terminal spring 16 is provided on the inner surface (top surface) of the bottom wall 11*a* of the box portion 11 so as to extend obliquely to the inside of the box portion 11 (i.e., upward) from a position on the base side of the lock hole 14 to a position on the tip side of the lock hole 14 like a cantilever and to stride the lock hole 14. A tip portion 15*a* of the supporting point portion 15 is in contact with or opposed with a slight gap to the bottom surface of the terminal spring 16 at a position around the center of its extension direction.

As shown in FIGS. 1A and 2A, the bottom wall 11*a* of the box portion 11 is formed with, at a position close to its tip-side end (closer to its tip than the lock hole 14 is), a rectangular through-hole 17 which permits entrance of a tip portion 16*a* (free-end-side end portion) of the terminal spring 16. An inside (top) edge of the base-side end surface of the through-hole 17 is formed with a chamfered portion 17*a*. Although in this example the chamfered portion 17*a* has a flat surface (tapered surface; what is called C chamfering), it may have a curved surface (what is called R chamfering). The base-side end surface of the through-hole 17 corresponds to the term "deformation restriction portion" used in the invention.

Figure 2B:
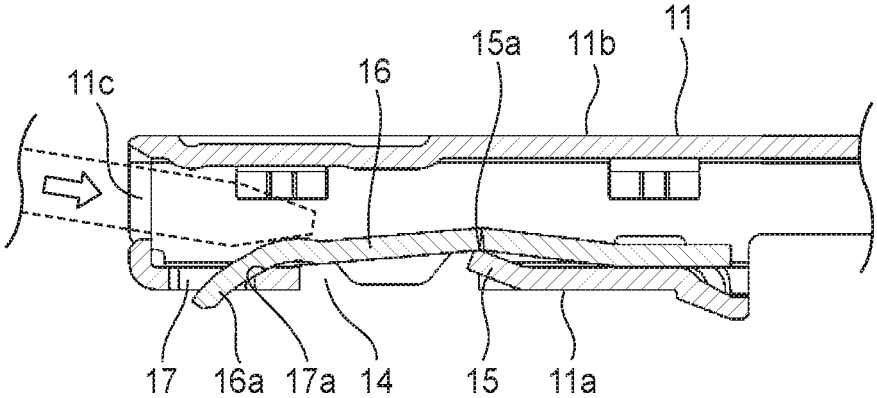
FIG. 2B is a sectional view corresponding to FIG. 2A and showing a state that a counterpart terminal is inserted in a box portion of the terminal metal fitting.
Figure 2C:
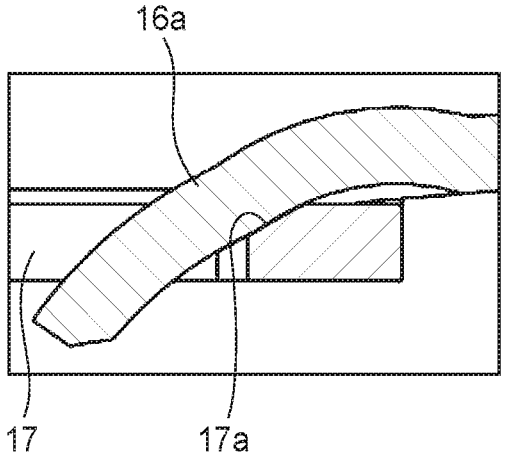
FIG. 2C is an enlarged view of part of FIG. 2B, that is, a tip portion of a terminal spring.

The tip portion 16*a* of the terminal spring 16 is bent downward. In other words, the tip portion 16*a* is curved so as to be convex upward. As shown in FIG. 2B, a counterpart terminal (male terminal) that is inserted through a tip-side opening 11*c* of the box portion 11 is sandwiched between the tip portion 16*a* of the terminal spring 16 and a top wall 11*b* of the box portion 11. When in this manner the terminal spring 16 is pressed against and brought into contact with the counterpart terminal, the tip portion 15*a* of the supporting point portion 15 functions as a supporting point for the terminal spring 16 that is deformed downward elastically. In addition, as shown in FIGS. 2B and 2C, the tip portion 16*a* of the terminal spring 16 being deformed downward passes through the through-hole 17, projects downward through the through-hole 17, and comes into contact with the chamfered portion 17*a* of the through-hole 17. These actions will be described later in detail.

As shown in FIGS. 3A and 3B, the housing 20 is equipped with a terminal housing portion 21 for holding the terminal metal fittings 10 and a lock arm 22 which is provided on a top surface of the terminal housing portion 21. When the housing 20 is fitted into a counterpart housing (not shown) which houses counterpart terminals, the lock arm 22 is engaged with an engagement portion of the counterpart housing. As such, the lock arm 22 performs a function of locking a connection state of the two housings.

The terminal housing portion 21 is equipped with terminal housing rooms 23 for housing the respective terminal metal fittings 10, insertion holes 24 through which the respective counterpart terminals are to be inserted, and the lances 25.

As shown in FIG. 3B, the terminal housing rooms 23 are open on the base side of the housing 20 and the terminal metal fittings 10 are inserted into the respective terminal housing rooms 23 from the base side of the housing 20.

As shown in FIG. 3B, each insertion hole 24 is open at the tip of the associated terminal housing room 23 and communicates with that terminal housing room 23. A counterpart terminal is inserted into the terminal housing room 23 through the insertion hole 24 and fitted into the box portion 11 of the terminal metal fitting 10 held in the terminal housing room 23. As a result, a state is maintained that the counterpart terminal and the terminal metal fitting 10 are electrically connected to each other.

As shown in FIG. 3B, the lance 25 is provided on the bottom surface, opposed to the bottom wall 11*a* of the box portion 11 of the terminal metal fitting 10 housed in the terminal housing room 23, of the terminal housing room 23. The lance 25 is an elastic piece that extends obliquely toward the inside of the terminal housing room 23 (i.e., upward) and toward the tip side like a cantilever from a prescribed position on the bottom surface of the terminal housing room 23.

Figure 4:
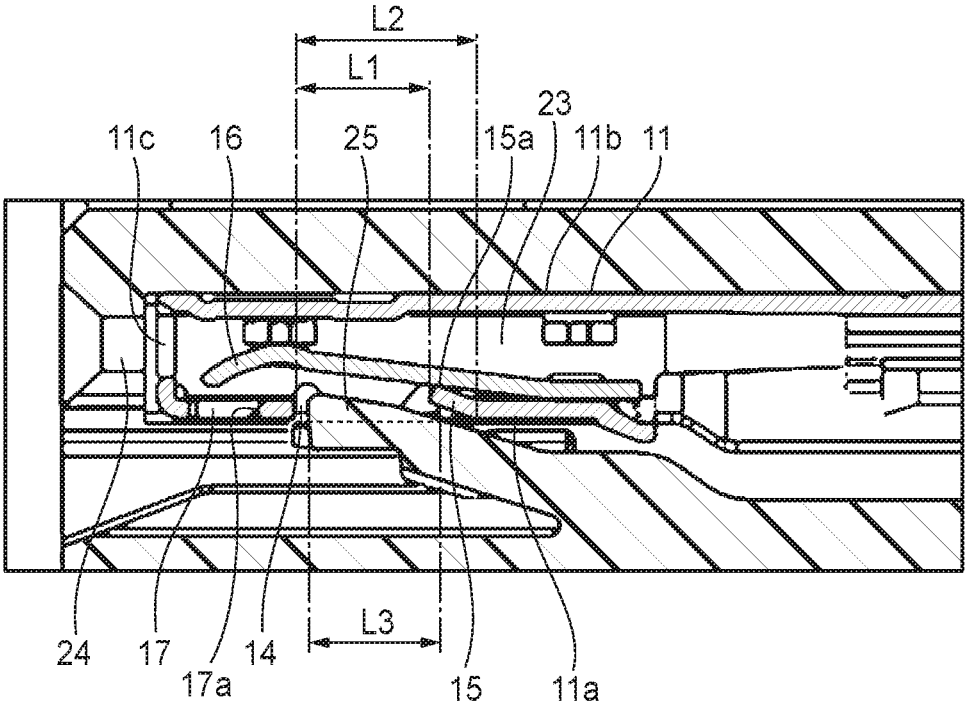
FIG. 4 is an enlarge view of part C of FIG. 3B.

In a halfway state of insertion of the terminal metal fitting 10 into the terminal housing room 23, the lance 25 is deformed downward elastically by interference with the bottom wall 11*a* of the box portion 11 of the terminal metal fitting 10. Upon completion of the insertion of the terminal metal fitting 10, the lance 25 returns to the original state while going into the lock hole 14 of the box portion 11 by its own elastic recovering ability. As a result, as shown in FIGS. 3B and 4, the lance 25 is received by the lock hole 14. Thus, a state is established that the tip surface of the lance 25 and the tip-side surface of the lock hole 14 are engaged with each other, whereby the terminal metal fitting 10 is prevented from coming off the terminal housing room 23.

As shown in FIG. 4, in a state that the lance 25 is received by the lock hole 14, whereas part of the lance 25 is located in the space formed between the tip end side portion of the lock hole 14 and the terminal spring 16 of the terminal metal fitting 10 and part of the lance 25 is located inside the lock hole in the frontward area, which is defined by the supporting portion 15, vacated by erecting the cut-and-erected piece, the terminal spring 16 is not in contact with the lance 25. When the counterpart terminal is inserted further into the box portion 11 of the terminal metal fitting 10 from the state of FIG. 4, though the terminal spring 16 is pushed downward (toward the lance 25), downward deformation of the terminal spring 16 is restricted because the tip portion 15*a* of the supporting point portion 15 functions as a supporting point for the terminal spring 16. As a result, the terminal spring 16 can be prevented reliably from interfering with the lance 25.

In the above operation, when the counterpart terminal is inserted into the box portion 11 of the terminal metal fitting 10 while being inclined and the terminal spring 16 is thereby pushed downward, as shown in FIGS. 2B and 2C, the tip portion 16*a* of the terminal spring 16 projects downward through the through-hole 17 and a portion, closer to the free end of the terminal spring 16 than the supporting point portion 15 is, of the terminal spring 16 comes into contact with the chamfered portion 17*a* of the through-hole 17. As a result, the deformation of the terminal spring 16 is restricted so as to fall within a preset range.

As described above, since the portion to come into contact with the tip portion 16*a* of the terminal spring 16 is the chamfered portion 17*a*, stress is less prone to concentrate in the contact portion of the terminal spring 16 than in a case that the portion to come into contact with the tip portion 16*a* of the terminal spring 16 is a sharply angled edge. Furthermore, when the tip portion 16*a* of the terminal spring 16 comes into contact with the chamfered portion 17*a*, the tip portion 16*a* which is curved like part of a convex shape is stretched being pushed by the counterpart terminal, which may cause an event that the tip portion 16*a* slides on the chamfered portion 17*a* while being kept in contact with the chamfered portion 17*a*. In this case, since the portion to come into contact with the tip portion 16*a* is the chamfered portion 17*a*, the tip portion 16*a* moves more smoothly than in a case that the portion to come into contact with the tip portion 16*a* is a sharply angled edge.

Furthermore, since the supporting point portion 15 is cut-separated and erected from the base-side end portion of the lock hole 14, the space between the tip end side portion of the lock hole 14 and the supporting point portion 15 can function as a space for receiving part of the lance 25. Also, the supporting point portion 15 defines a frontward area vacated by erecting the cut-and-erected piece, and when part of the lance 25 is received into the lock hole 14, a part of the lance 25 is located inside the frontward area. Thus, the dimension in the fitting direction, relating to reception of the lance 25, of the lock hole 14 is increased from a dimension L1 of a case that the supporting point portion 15 is not formed to a dimension L2 of this structure (see FIG. 4). This makes it possible to receive, through the lock hole 14, a larger lance 25 than in the case that the supporting point portion 15 is not formed.

In the following, a dimension in the fitting direction of a cross section obtained by cutting the lance 25 received by the lock hole 14 by a plane containing the opening of the lock hole 14 will be referred to as a shearing distance L3 (see FIG. 4). During using the terminal metal fitting 10, when external force acts on the terminal metal fitting 10 while it is being used, in such a direction as to pull it out from the terminal housing room 23, the tip-side surface of the lock hole 14 pushes the tip surface of the lance 25, whereby shearing stress acts on the lance 25 in the fitting direction.

In the embodiment, the terminal metal fitting 10 can receive, through the lock hole 14, a lance 25 that is increased in the shearing distance L3 by the increase of the dimension in the fitting direction, relating to reception of the lance 25, of the lock hole 14 from L1 to L2. Thus, when external force as mentioned above is exerted on the terminal metal fitting 10, the shearing stress that acts on the lance 25 in the fitting direction is decreased by a value corresponding to the increase of the shearing distance L3. As a result, when external force is exerted on the terminal metal fitting 10, the lance 25 is less prone to be deformed. Even if the tip-side surface of the lock hole 14 bites into the lance 25, the lance 25 can withstand deeper biting by the increase of the shearing distance L3.

In the terminal metal fitting 10 according to the embodiment of the invention, when an inclined counterpart terminal is brought into contact with the terminal spring 16 inside the tubular box portion 11, if no proper measure were taken, excessive stress might act on the terminal spring 16 to deform it plastically. In contrast, since the portion to come into contact with the terminal spring 16 is the chamfered portion 17*a*, stress is less prone to concentrate in the contact portion of the terminal spring 16 than in a case that the portion to come into contact with the terminal spring 16 is a sharply angled edge. Thus, the terminal spring 16 is less prone to plastic deformation. As such, the terminal metal fitting 10 can attain both of suppression of deformation of the terminal spring 16 and keeping of necessary reliability of electrical connection to a counterpart terminal.

Furthermore, when an inclined counterpart terminal is brought into contact with the terminal spring 16, the portion, closer to the free end than the portion in contact with the supporting point portion 15 is, of the terminal spring 16 which is curved being supported by the supporting point portion 15 comes into contact with the chamfered portion 17*a* which is formed on the base-side edge of the through-hole 17. When this contact occurs, the tip portion 16*a*, curved like part of a convex shape, of the terminal spring 16 is stretched being pushed by the counterpart terminal, which may cause an event that the tip portion 16*a* slides on the chamfered portion 17*a* while being kept in contact with the chamfered portion 17*a*. In this case, since the portion to come into contact with the tip portion 16*a* is the chamfered portion 17*a*, the tip portion 16*a* moves more smoothly than in a case that the portion to come into contact with the tip portion 16*a* is a sharply angled edge. As a result, the deformation of the terminal spring 16 can be suppressed.

OTHER EMBODIMENTS

In addition, the invention is not limited to the aforementioned embodiments, but various modifications can be used within the scope of the invention. For example, the invention is not limited to the aforementioned embodiments, but changes, improvements, etc. can be made on the invention suitably. In addition, materials, shapes, dimensions, numbers, arrangement places, etc. of respective constituent elements in the aforementioned embodiments are not limited. Any materials, any shapes, any dimensions, any numbers, any arrangement places, etc. may be used as long as the invention can be attained.

Although in the above-described embodiment the box portion 11 of each terminal metal fitting 10 is shaped like a rectangular cylinder. However, the box portion 11 of each terminal metal fitting 10 may be shaped like a circular cylinder, in which case an electric wire to be connected to each terminal metal fitting 10 may be a coaxial cable.

The features of the above-described terminal metal fitting 10 according to the embodiment of the invention will be summarized concisely below in the form of items [1] and [2].

[1] A terminal metal fitting (10) comprising:

a tubular box portion (11) receiving a counterpart terminal;

a terminal spring (16) extending from an inner wall surface of the box portion (11) to press and contact to the counterpart terminal; and a deformation restriction portion (base-side end surface of the through-hole 17) restricting deformation of the terminal spring (16) within a preset range upon the terminal spring (16) contacting to the counterpart terminal, the deformation restriction portion (base-side end surface of the through-hole 17) having a chamfered portion (17*a*) as a portion to contact to the terminal spring (16).

[2] The terminal metal fitting (10) according to the item [1], further comprising a supporting point portion (15) having a shape to project inside of the box portion (11) and serving as a supporting point (15*a*) upon the terminal spring (16) pressing and contacting to the counterpart terminal, wherein the terminal spring (16) has a cantilevered-shape; and the deformation restriction portion (base-side end surface of the through-hole 17) restricts the deformation of the terminal spring (16) within the preset range by contacting to the terminal spring (16) at a position closer to a free end of the terminal spring (16) than a contacting portion of the supporting point portion.

REFERENCE SIGNS LIST

10: Terminal metal fitting
11: Box portion
15: Supporting point portion
15*a*: Tip portion (supporting point)
16: Terminal spring
17: Through-hole
17*a*: Chamfered portion

The invention claimed is:

1. A terminal metal fitting comprising:

a tubular box portion receiving a counterpart terminal;

a terminal spring extending from an inner wall surface of the box portion on a base side toward a tip side opposite the base side to press and contact the counterpart terminal; and a deformation restriction portion restricting deformation of the terminal spring within a preset range upon the terminal spring contacting the counterpart terminal, the deformation restriction portion having a chamfered portion to contact the terminal spring, wherein the box portion includes a lock hole configured to receive a lance of a connector housing, wherein the box portion includes a supporting point portion, which is a cut portion around the lock hole, the cut portion being erected obliquely inside of the box portion and extending forwardly to have a cantilevered-shape, and which serves as a supporting point upon the terminal spring pressing and contacting the counterpart terminal, wherein the box portion has a through hole, wherein the terminal spring has a tip portion configured to pass through the through hole and project outwardly from the through hole when the terminal spring makes contact with the chamfered portion of the deformation restriction portion, and wherein the supporting point portion defines a frontward area vacated by erecting the cut portion, and a part of the lance is located inside the frontward area upon the lance being received into the lock hole.

2. The terminal metal fitting according to claim 1, wherein the terminal spring has a cantilevered-shape; and the deformation restriction portion restricts the deformation of the terminal spring within the preset range by contacting the terminal spring at a position closer to a free end of the terminal spring than a contacting portion of the supporting point portion.

* * * * *